United States Patent [19]

Camossi

[11] Patent Number: 4,574,955

[45] Date of Patent: Mar. 11, 1986

[54] BOX LIKE CONTAINER INCLUDING A BASKET FOR RECEIVING A LOAD, SUPPORTED BY THE BOX BY MEANS OF SHOCK AND VIBRATION DAMPING MOUNTS SECURED THEREBETWEEN IN DEMONTABLE MANNER

[75] Inventor: Carlo Camossi, Gozzano, Italy

[73] Assignee: Cavoflex Ammortizzatori a cavo metallico s.r.l., Gozzano, Italy

[21] Appl. No.: 655,571

[22] Filed: Sep. 28, 1984

[51] Int. Cl.[4] ..... B65D 81/02; B65D 85/30

[52] U.S. Cl. ..... 206/583; 206/386

[58] Field of Search ..... 206/583, 521, 386; 217/55, 54, 53

[56] References Cited

U.S. PATENT DOCUMENTS

| | | | |
|---|---|---|---|
| 2,688,059 | 8/1954 | Holzinger et al. | 206/583 |
| 2,799,778 | 7/1957 | Stephenson | 206/583 |
| 2,932,546 | 4/1960 | Marggrat et al. | 206/583 |
| 3,292,884 | 12/1966 | Scheldurf | 206/583 |
| 4,013,170 | 3/1977 | Hutteren | 206/583 |

*Primary Examiner*—Joseph Man-Fu Moy

[57] ABSTRACT

A container consisting of a box provided with a lid and in the inside of which is suspended by four suspension mounts a basket for receiving a load. The box and the basket form therebetween a free space of a constant thickness. The suspension mounts are each mounted between an outer corner of the basket and inner corner of the box which face each other and which are perpendicular to the plane of the entrance opening of the box. Each mount comprises an outer saddle section and an inner saddle section between which are interconnected one or more damping devices including a wire cable forming helical loops or turns; each outer saddle section is fixed, in disassemblable manner, to the box and to the damping device or devices and each inner saddle section is fixed, in similar manner, to the basket and to the respective damping device or devices. All the mounts have a fixed height, since any increase or decrease of the height of the damping devices is compensated by a decrease or increase respectively of the height of the saddle sections.

4 Claims, 7 Drawing Figures

BOX LIKE CONTAINER INCLUDING A BASKET FOR RECEIVING A LOAD, SUPPORTED BY THE BOX BY MEANS OF SHOCK AND VIBRATION DAMPING MOUNTS SECURED THEREBETWEEN IN DEMONTABLE MANNER

FIELD OF THE INVENTION

The present invention relates to shock-resistant and anti-vibration, transportable containers of a prismatic shape and including a basket or frame, designed to house delicate apparatus, as, for instance, electric or electronic apparatus.

BACKGROUND OF THE INVENTION

The known containers for such intended purposes comprise an outer box or casing, provided with a lid and with an inner basket connected to and supported by said box by means of shock and vibration damping means formed by wire cables or ropes.

Said containers must be subjected to different tests so as to be able to value their capacity of being subjected to predetermined operative conditions, in order to ensure the integrity of the apparatus or the like, which will be inserted therein. The rules in force in this field require fall, vibration and shock tests, as well as resistance tests under the change of the climatic, ambient or other conditions.

The damping devices, made of wire cables or ropes and mounted in these known containers, have been always designed in function of predetermined use conditions, in particular, in function of the weight of the apparatus which will be inserted in the basket. Therefore, each container is designed to be used only for a given intended purpose. In fact, heretofore, no possibility was given of constructing standard containers of such a type which could be used for receiving apparatus of different weights and/or for different operative conditions.

SUMMARY OF THE INVENTION

Thus it is an object of the present invention to modify the structure of the containers of the aforementioned type, in order to provide a container consisting of an outer box and of an inner basket, having standard dimensions, and that, at the same time, could be adapted to be used in different operative conditions, in particular, adapted to receive less or heavier loads and/or loads which can be less or more stressed.

For such a purpose provisions has been made that the outer box and the inner basket have similar shapes and fixed dimensions which are such that the basket can remain suspended within the box in such a way, that a hollow space is created between them having a fixed and constant thickness, said basket being supported by the box, owing only four suspension mounts which provide the effective damping of any shock and/or vibration and which are secured along the corners of the box and of the basket, which are set at right angles to the entrance opening of the container. Said suspension mounts are, therefore, effective in the planes, bisecting the outer solid angles of the basket and the inner ones of the box, respectively; in these planes these mounts have a constant height.

For providing an elastic suspension, each mount consists of elements of a saddle cross section, between which one or more damping devices of an already known type are inserted, which have been the objects of other former patents. Each of said damping devices consists of a wire cable, preferably, of stainless steel, and formed by two or more strands. The cable is wound up so as to form helical loops or turns, which are clipped and anchored to pairs of longitudinal, parallel, shaped strips or plates which are securedly fixed to said loops in substantially diametrally opposite points of the helical winding of the cable. The pairs of co-operating strips or plates, which squeeze therebetween the cable loops, are, in turn, connected, in disassemblable manner, to the corner portions of the basket and of the box, respectively. The outer corner portions of the basket and the inner ones of the box, where the suspension mounts are secured, are, furthermore, so shaped as to make easy the connection of said sattle sections or irons to the body of the basket and to that of the box, respectively.

Such a solution permits to use damping devices having different characteristics, according to the solution in question; these damping devices, in these cases, as it is well known, require the use of cables of a different diameter and which form loops or turns of a different outer diameter. As a result thereof, in order to fit said damping devices with the different operative conditions, they must have a different height, when measured in their longitudinal center plane, which is set at right angle to the planes of the strips or plates locking the helical loops. Therefore, any increase or decrease of the height of the damping device or devices included in each suspension mount will be compensated by a decrease or increase, respectively, of the height of the respective sattle irons, said height being calculated in the center plane X—X of said suspension mount, said plane being coincident with the longitudinal center plane of the damping device or devices of said suspension mount. Therefore, the containers can be constructed according to standardized types which can be readily and easily fitted so as to be able to operate in different operative conditions, by the simple substitution of the present suspension mounts with other ones which are suited to resist to the different foreseen forces, but which have the same height D in their center plane X—X. Such a constant height D of all the suspension mounts is, however, very short, owing to the specific features of the special damping devices included therein, which "per se", permit to obtain a very efficient damping effect against the shock and the vibration forces directed in any of the triorthogonal directions x, y and z, where the direction z coincides with that of the axis of winding of the damping device or devices inserted in an aligned relationship, in each suspension mounts, while the axis x, lies in the longitudinal center plane X—X.

BRIEF DESCRIPTION OF THE DRAWINGS

The invention will be better understood, when reference is made to the embodiment thereof, shown in the accompanying drawings, in which.

DETAILED DESCRIPTION OF THE INVENTION

Figure 1:
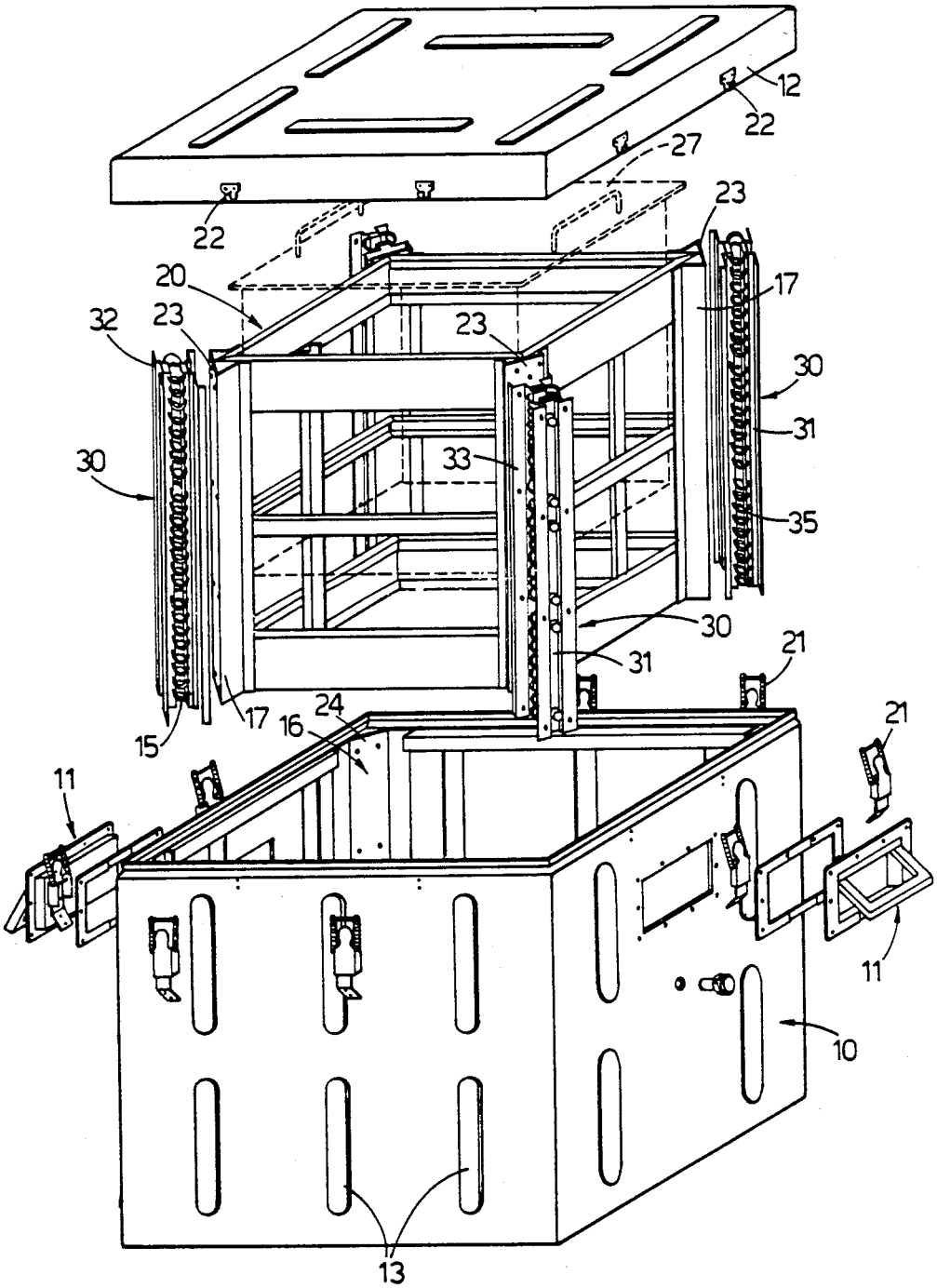
FIG. 1 is a diagrammatic exploded perspective view of the whole container, carried out according to the present invention.

Referring now to FIG. 1, therein it can be seen, that the container consists of an outer box, generally indicated 10, the walls of which are provided with ribs 13 or the like for the stiffening thereof. At least, two gripping handles 11 are provided which are flush-mounted in the outer wall surfaces, in order to reduce the space occupied by the container, and so as to make easier the transport and the storing of this latter. The box 10 is provided with a lid 12 for closing the box 10 and which is locked to this latter by known means, as, for instance, by lever hooks 21 hinghed to the outer walls of the box 10 and co-operating with, and engaging hocking teeth 22 extending outwards from the side surfaces of the lid 12 (FIG. 1).

In the shown embodiment, the container has a horizontal entrance opening so that the suspension mounts, generally indicated 30, will be secured near the pairs of vertical facing corners of the basket 20 and the box 10, respectively. Said basket 20 consists of a structure, preferably of a latticed or perforated type, that is adapted to receive in its inside the apparatus 27 to be transported in a protected condition and which has been diagrammatically represented in dotted lines in FIG. 1. The basket 20 has a shape similar to that of the box 10, which, in general, is rectangular in plan, but these two bodies have such dimensions that the basket can remain suspended within the box 10, owing to the suspension mounts 30, but forming therebetween a free space 14 of a constant thickness. In order to make easier the assembling of the suspension mounts 30 and to permit their substitution, the inner corners of the box 10 and the outer ones of the basket 20, between which the suspension mounts 30 are interconnected, are suitably shaped so as to form flat support surface portions for the connection of said mounts 30 to the basket 20 and to the box 10, respectively. For such a purpose, along the vertical corner portions of the basket 20 can be secured irons 17 provided with a flat wall 23 set at right angle with regard to the bisecting plane X—X of the solid angles formed between the adjacent walls of the box 10 and of the basket 20 and which meet in the corners, between which each respective suspension mount is interconnected. In the same way, on the box 10 along the inner vertical corner portions thereof shape irons 16 are secured, having a flat wall perpendicular to the bisecting plane X—X. It is evident, that, in the event that the box 10 and/or the basket 20 would be constructed by moldable materials according to a molding process, instead of using inserted shaped irons 16 and 17, such special corner outiles could be directly obtained in the bodies of the box 10 and of the basket 20, respectively.

Figure 2:
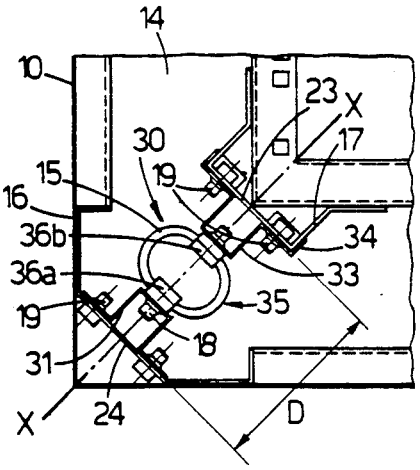
FIGS. 2 and 3 are the enlarged top views, respectively, of the detail of a corner area of the container, where the suspension mounts are installed and where said mounts are designed to operate according to two different operative characteristics.
Figure 3:
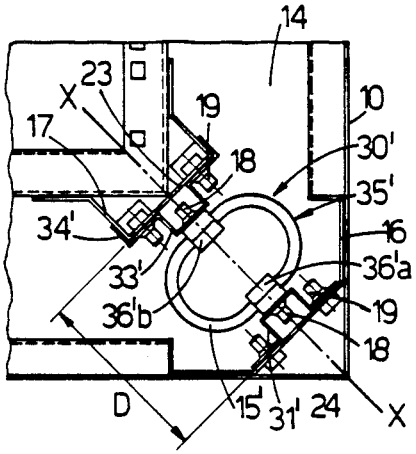
Figure 4:
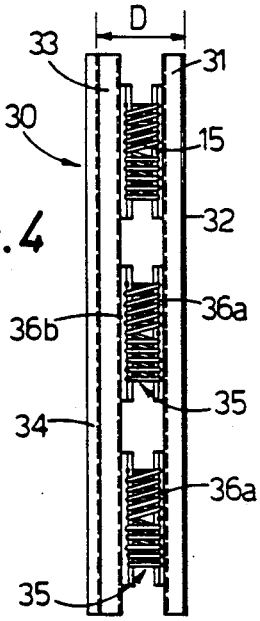
FIGS. 4 and 4*a* are the side view and the top view, respectively, of the suspension mount alone, shown in FIG. 2.
Figure 5:
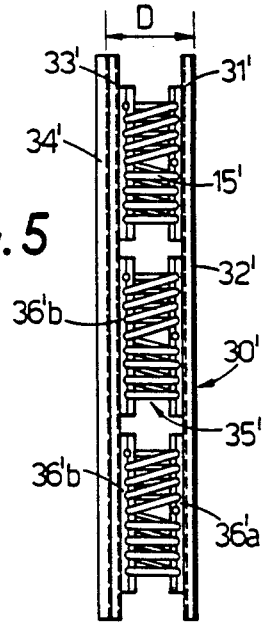
FIGS. 5 and 5*a* are views similar to those of FIGS. 4 and 4*a*, but which relate to the suspension mount alone of the variant, shown in FIG. 3.
Figure 4A:
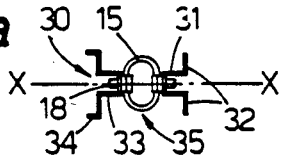
Figure 5A:
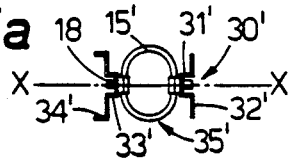

All the suspension mounts 30, mounted in each container, are identical to each other. Each mount 30 comprises a pair of sattle-like sections, which, in the embodiment of FIGS. 2 and 3, are indicated 31, 33 and in that of FIGS. 3 and 5 are indicated 31′, 33′. Between the pairs of sattle sections 31, 33 one or more damping devices, generally marked 35 or 35′, are mounted in an aligned disposition.

The damping devices 35 or 35′ are each constituted of a wire cable or rope 15 or 15′, formed by two or more strands and having a diameter depending upon the foreseen forces.

Each cable 15 or 15′, according to a well known solution, forms a plurality of helical loops or turns, the outer diameter of which depends upon the diameter of the cable, i.e. upon of the foreseen stresses. The loops or turns are locked between two pairs of co-operating shaped strips or plates 36*a*, 36*b*, and 36*a*′, 26*b*′, respectively, which, in turn, are locked to each other as well as to the cable 15 or 15′. In addition, they are connected, in a disassemblable manner, to the respective saddle sections 31, 33 or 31, 33′ by screws 18. Each outer saddle sections 31 or 31′ is provided with longitudinal co-planar flanges 32 or 32′ designed to lie in contact with the wall portion 24 of the shaped sections 18, while the inner saddle sections 33 or 33′ are provided with longitudinal flanges 34 or 34′ so shaped as to be able to lie against the flat wall 23 of the respective shaped section 17, partially also contacting the contiguous wall surfaces of this latter. The saddle sections 31, 33 or 31′, 33′ are secured, in removable manner, to said sections 16 and 17 by means of screws 19 (FIGS. 2 and 3).

As the suspension mounts 30 have been installed in their use position, the longitudinal center planes of this latter become coincident with the respective bisecting planes X—X of angles formed by the walls of the box 10 and of the basket 20, which passes through the facing corners, which are set at right angles to the entrance opening plane of the container.

In FIGS. 2, 4, 4*a* and 3, 5, 5*a* there are illustrated, as embodiments, respectively, two variants of suspension mount 30. The mount 30, shown in FIGS. 2, 4, 4*a*, comprises three damping devices 35 so proportioned as to be able to operate in presence of low stresses, so that the diameter of the cable 15 and the outer diameters of the loops or turns are shorter than those of the damping device 35′ included in the mount 30′, shown in FIGS. 3, 5, 5*a*. It results that each damping device 35 has a height, -measured in its longutudinal center plane set at right angles to the planes of the respective locking strips or plates-, shorter than that of damping device 35′ included in the mount 30′. Such a difference in their height will be compensated by a proportional increasing of the height of the saddle sections 31, 33 of the mount 30, and by a decreasing, respectively, of the height of the saddle sections 31′, 33′ included in the mount 30′, so that the mounts 30 and 30′ will thus have always the same total height D in the plane X—X in order that the pluralities of mounts 30 and 30′, . . . are interchangeable in the container. Of course, any number of different mounts 30, 30′, . . . may be provided. Therefore, in the event of different stress conditions and/or of different weight of the load 27, suspension mounts having a constant global height D will be always used, while the height of the saddle sections included in said mounts, increases or decreases, when the height of the damping device or devices decreases or increases, said heights being measured in the center plane X—X of the suspension mounts, which coincides with the longitudinal center planes of the damping devices included in each mount.

I claim:

1. A container consisting of a box, in the inside of which is suspended a basket by means of mounts, said basket being designed to receive a load, characterised by the fact that the box (10) and the basket (20) have similar shaped so that a free space of a constant thickness is formed therebetween, while the suspension mounts (30, 30', . . . ) are mounted between the box (10) and the basket (20) in corrispondence of the respective bisecting planes X—X of the inner solid angles formed between the wall surfaces and passing through the corners thereof, which are perpendicular to the entrance opening of the box (10, to be closed by a lid (12), said mounts (30, 30', . . . ) having a constant height D, measured on the longitudinal center plane of each mount (30, 30', . . . ), each mount (30, 30', . . . ), comprising an outer saddle-like section (33, 33', . . . ) and an inner saddle section (33, 33', . . . ), between which at least one damping device (35, 35', . . . ) is interconnected, comprising loops or turns of a helical coil, made of wire cable (15), and two pairs of strips or plates (**36*a*, 36*b*), each strip pair locking the loops or turns of the cable in diametrally opposite points and being respectively connected to the respective sattle section (31, 31', . . . or 31', 33', . . . ), in a disassemblable manner, said mounts (30, 30', . . . ) including sattle sections (31, 31', . . . and 33, 33', . . . ) of such a height that the sum of these heights and of that of the associated damping device or devices (35, 35'**, . . . ) be always equal to D, so that any greater height of the damping devices will be compensated by a corresponding shorter height of the associated saddle sections.

2. A container according to claim 1, wherein in the zones of the outer corner portions of the basket (20) and of the inner ones of the box (19), flat surfaces (23, 24) are provided, set at right angles to the respective bisecting planes X—X and designed to constitute supporting planes for the respetive sattle-sections (31, 31', . . . 33, 33', . . . ) of the mounts 30, 30', . . . ) respectively, for such a purpose said saddle sections being provided with longitudinal support shaped flanges (32, 34) respectively.

3. A container according to claim 1, wherein the support flat surfaces (23, 24) are obtained on shaped inserted pieces or sections (18, 19) securely fixed to the box (10) and the basket (20), respectively.

4. A container according to claim 1, wherein the flanges (32, 34) of the saddle sections (31, 31', . . . 33, 33', . . . ) are secured to the flat surfaces (24, respectively 23) by screws (18), while other screws (18) lock the sattle sections (31, 31', . . . 33, 33', . . . ) to the pairs if strips or plates (**36*a*, 36*b*) of the respective damping devices (35, 35'**, . . . ), associated therewith.

* * * * *